United States Patent [19]

Jacobson et al.

[11] 4,074,451

[45] Feb. 21, 1978

[54] DISPLAY DEVICE

[76] Inventors: Sidney I. Jacobson, 4248 D'Este Court, Apt. 104, Lake Worth, Fla. 33463; Harold D. Jacobson, 2126 Valley Road, Northbrook, Ill. 60062; Arthur F. Jacobson, 1281 Lynn Terrace, Highland Park, Ill. 60035

[21] Appl. No.: 712,858

[22] Filed: Aug. 9, 1976

[51] Int. Cl.[2] ..... G09F 1/00; A47B 65/00

[52] U.S. Cl. ..... 40/610; 211/42; 40/611

[58] Field of Search ..... 40/125 H, 11 A; 211/42, 211/43, 57, 59, 78, 133, 153

[56] References Cited

U.S. PATENT DOCUMENTS

| | | | |
|---|---|---|---|
| 1,396,910 | 11/1921 | Annable | 211/42 |
| 3,149,727 | 9/1964 | Magers | 211/133 |
| 3,315,936 | 4/1967 | Dautch | 211/42 |
| 3,800,958 | 4/1974 | Dorn | 211/43 |
| 3,830,375 | 8/1974 | Larson | 211/59.1 |

OTHER PUBLICATIONS

"Request for Office Supplies and Forms"; U.S. COM-M-DC 55087-P67.

*Primary Examiner*—Samuel W. Engle
*Assistant Examiner*—Donald P. Walsh
*Attorney, Agent, or Firm*—Wallenstein, Spangenberg, Hattis & Strampel

[57] ABSTRACT

A point-of-purchase display device having order blanks detachably supported thereon. The order blanks are provided with printed indicia which enable a purchaser to order an article, or articles, supported on the device in accordance with specifications which meet the purchaser's particular requirements.

5 Claims, 7 Drawing Figures

DISPLAY DEVICE

The present invention relates to a display device, and, in particular, to a point-of-purchase display device in conjunction with which a unique ordering system is used.

The value of point-of-purchase display devices as vehicles for the promotion and sale of merchandise is widely recognized by sales people both at the manufacturing and retail levels. Generally speaking, these devices, especially at the retail level, are used to display various models of items such as pens, watches, or the like. A purchaser simply selects a model he or she desires, and completes the purchase through a sales person. While point-of-purchase display devices of the type used for displaying different models of items such as pens and watches have found widespread acceptance, heretofore, so far as is known, no point-of-purchase display device has been evolved which is capable of being used for items, the sale of which is contingent upon satisfying a number of variables in order to meet the requirements of each individual purchaser. Included in this special group of items are ring or loose-leaf binders of the type frequently used by companies for in-house purposes, and outer covers for catalog sheets of products manufactured by a company or produced by a manufacturer's agent desirous of assembling various lines of merchandise handled by him for presentation of a complete showing of such products to a customer. Business people are prone to purchase binders having characteristics which will identify them with the purchaser's company. Thus, color, cover size, ring size, capacity, and the material of which the binder is made, printing describing the product, name, address, and phone number of manufacturer or representation, among other variables, are important considerations to purchasers of such items.

In accordance with the present invention, a point-of-purchase display device has been provided for ring or loose-leaf binders which will enable a purchaser to select and order a binder to meet his exact specifications, and, moreover, to do so quickly and accurately without the assistance, in most instances, of sales personnel.

Briefly, the display device comprises a self-supporting article receiving portion having a base and upwardly and rearwardly extending side supports. The base and side supports define an opening at the front of the article receiving portion which enables a plurality of ring or loose-leaf binders to be positioned on the base. Joined to the article receiving portion is an upwardly extending order blank supporting portion having means for attaching a plurality of order blanks. The order blanks are provided with indicia thereon which can be correlated with specific features of one, or more, of the loose-leaf binders supported on the article receiving portion of the device, and enable a purchaser to self-initiate the ordering of binders to his exact specifications. After the purchaser has filled-in the order blank, it is handed over to a sales person who retains a copy, gives a copy to the purchaser, and sends the original to the manufacturer of the binders for completion of the order. Not only does this arrangement save the time of sales personnel, but, also, it eliminates to a substantial extent the onus of customer complaints which, in the absence of the self-ordering system, could be attributed to errors committed by sales personnel.

The foregoing, and other features and advantages of the invention will become clear from the following description when taken in conjunction with the accompanying drawings wherein.

Figure 1:
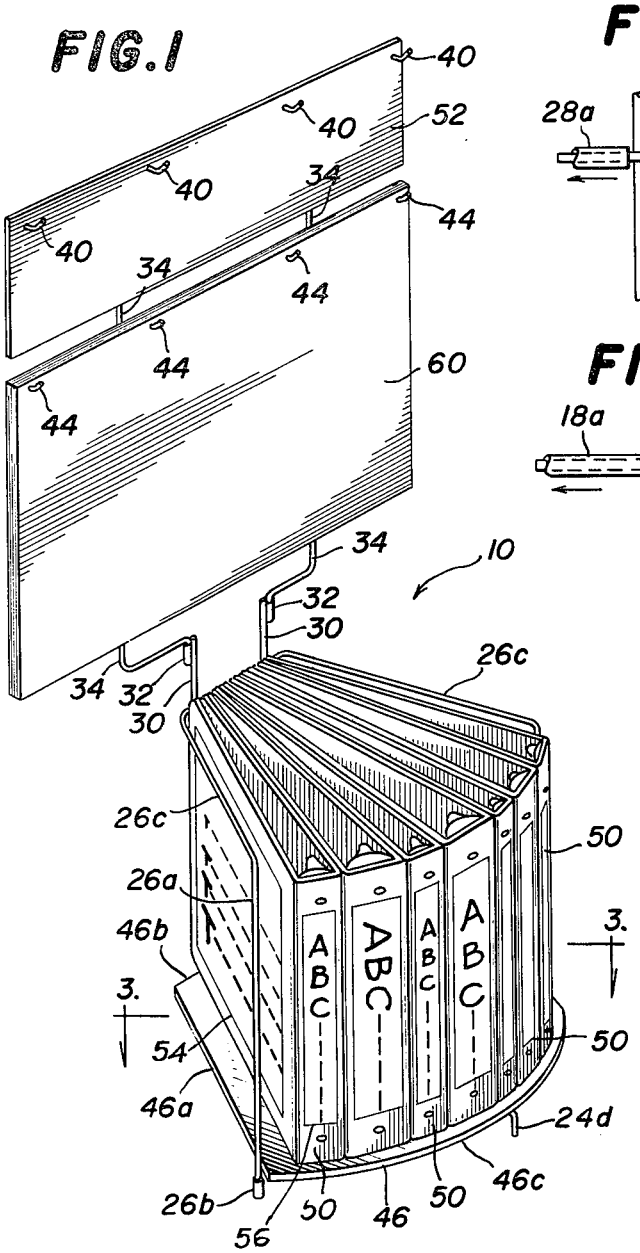
FIG. 1 is a view in perspective of an embodiment of the device showing loose-leaf binders and order blanks in position thereon.
Figure 4:
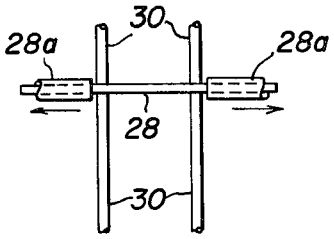
Figure 5:
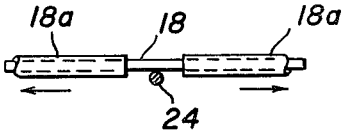
Figure 3:
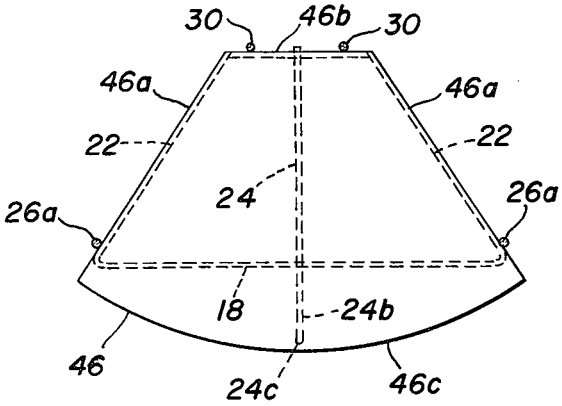
Figure 6:
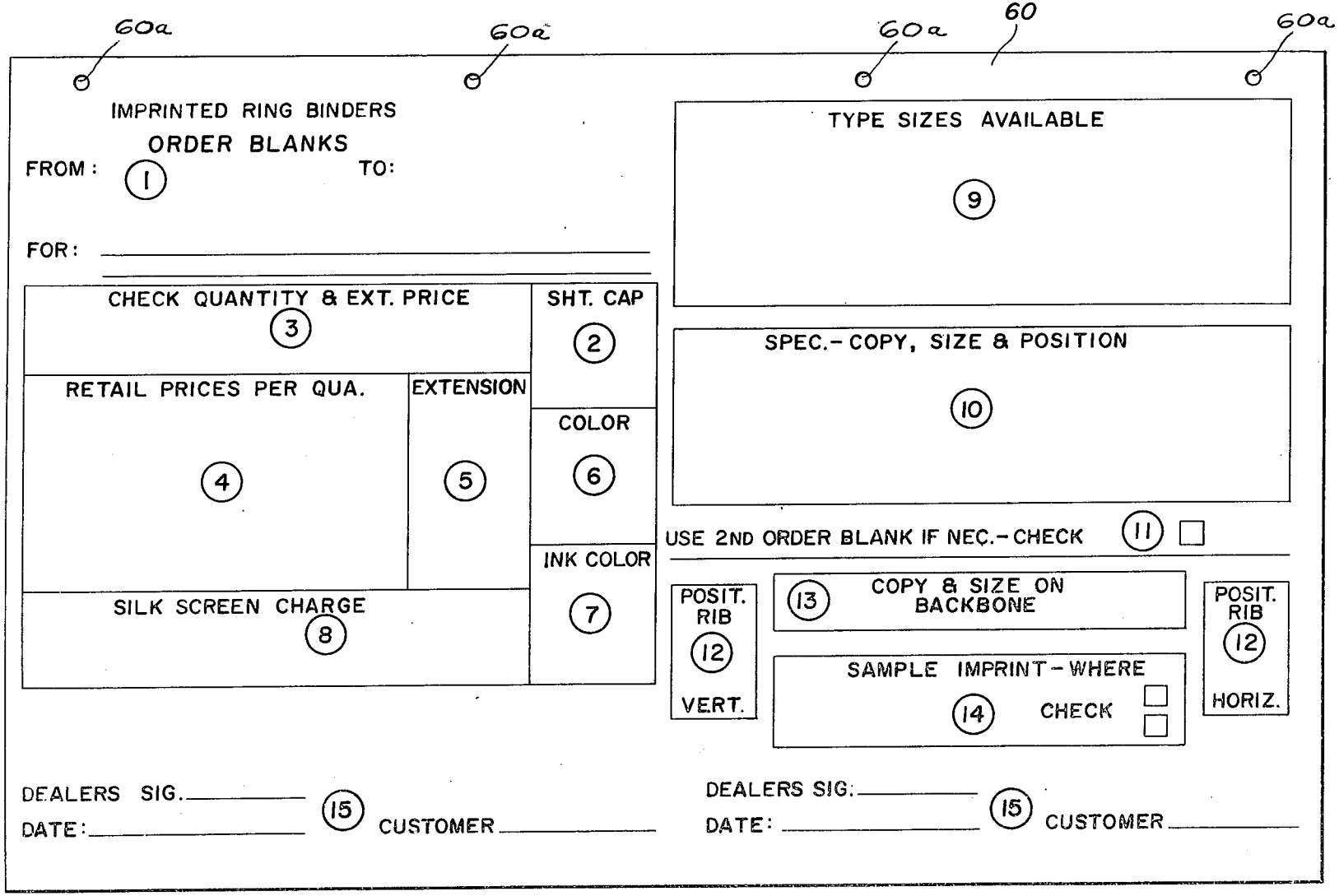

FIG. 3 is a sectional view taken substantially along line 3—3 of FIG. 1; and FIGS. 4 and 5 are fragmentary views showing a modification in the article receiving portion of the device enabling it to be extended to receive more articles, or to be retracted to receive fewer articles; and FIG. 6 is a front plan view in elevation of an embodiment of an order blank used on the device of the present invention.

The illustrated embodiment of the display device, designated generally by reference numeral 10 in FIG. 1, comprises a framework 12 (see FIG. 2) having an article receiving portion 14 and an order blank supporting portion 16. The framework 12 may be formed of wood or plastic, but advantageously is fabricated of brass or steel rods or wire.

The article receiving portion 14 has a generally trapezoidally shaped base formed by an elongated front member 18 and a shortened back member 20, each of which is joined at its ends to rearwardly and inwardly extending side members 22—22. A centrally positioned reinforcing member 24 is joined at its inner end **24*a* to the upper or lower surface of the member 20 at the center thereof, and at a point inwardly of its outermost end 24*b* to the bottom or top surface of the member 18 intermediate the ends thereof, which serves to maintain the display and merchandising samples on a horizontal plane. The end 24*b* of the reinforcing member 24 is bent outwardly and upwardly to provide a support surface 24*c*. At the support surface 24*c*, the end 24*b* terminates in a downwardly extending substantially vertical leg 24*d***.

Joined to the outer lateral surface of the side members 22—22 at a point inwardly from their juncture with the ends of the member 18, are upwardly and rearwardly extending side support members 26—26. The lower ends of the upwardly extending arms **26*a*—26*a* of the side supports 26—26 form legs 26*b*—26*b* which aid in supporting the device 10 on a surface. The rearwardly extending arms 26*c*—26*c* of the side support members 26—26 are joined at their innermost ends to a back member 28. If desired, the members 18, 20 and 28** can be made adjustable as to their lengths with appropriate modifications in the members connected thereto.

Figure 2A:
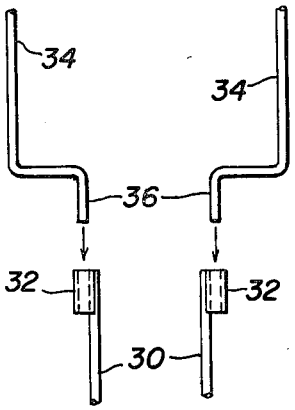
FIG. 2A is a fragmentary front view showing the manner in which the order blank supporting portion is attached to the article receiving portion of the embodiment of the device shown in FIG. 1.
Figure 2:
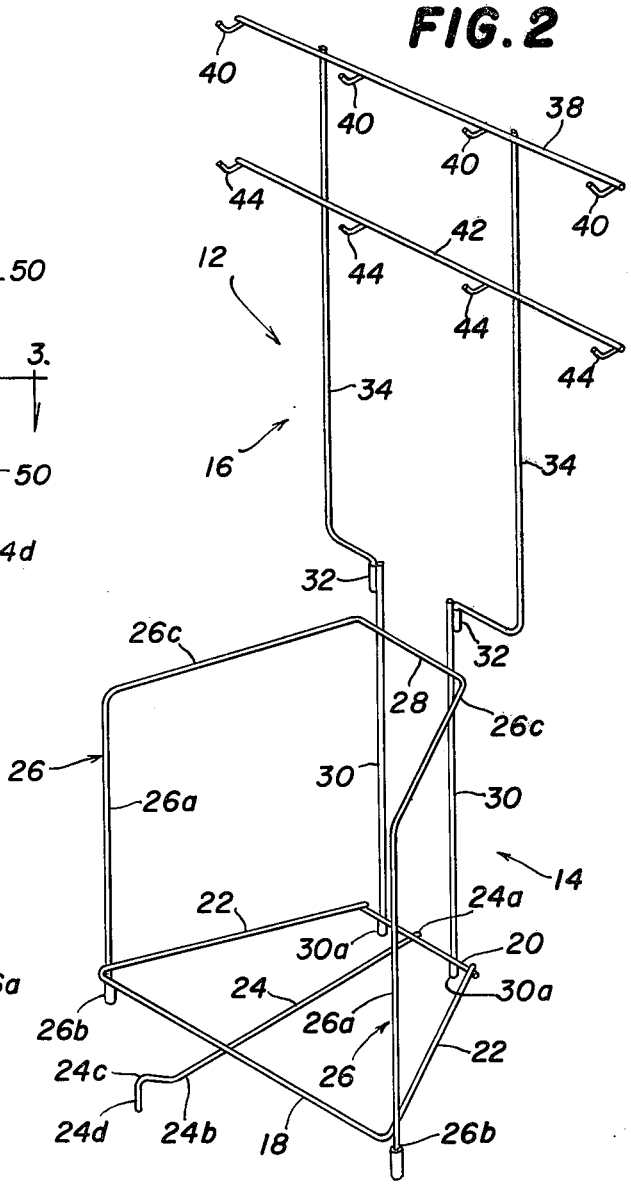
FIG. 2 is a view in perspective of the wire framework of the embodiment of the device shown in FIG. 1.

A pair of spaced, upwardly extending support members 30—30 are secured to the rear surface of the members 20 and 28 of the article receiving portion 14. The lower ends of the members 30—30 form legs **30*a*—30*a* which cooperate with the leg 24*d* formed at the outermost end of the reinforcing member 24, and the legs 26*b*—26*b* of the side support members 26—26 to support the device on a surface. As best shown in FIG. 2A, the upper ends of the members 30—30 are provided with ferrules 32—32**, the purpose of which will become clear as the description proceeds.

The order blank supporting portion 16 of the framework 12 comprises a pair of spaced, upwardly extending main support members 34—34, the lower ends of which are bent inwardly and then downwardly to provide extensions 36—36 adapted to be received in the ferrules 32—32. A sign support member 38, having a plurality of spaced, outwardly extending hooks or retaining members 40, is secured to the main support members 34—34 at the upper ends thereof to provide a rigid structure. An order blank support member 42, having a plurality of spaced, outwardly extending hooks or retaining members 44, is secured to the main support members 34—34, below and in spaced relation with respect to the member 38.

As shown in FIG. 3, a support or base plate 46 advantageously is provided for the article receiving portion 14. The plate 46 may be made of plastic, metal, wood, composition board, or the like. The inwardly and rearwardly extending sides **46*a*—46*a* of the plate 46 are adapted to be supported on the members 22—22 of the base of the article receiving portion 14, while the rear margin 46*b* of the plate 46 is adapted to be supported on the innermost end 24*a* of the reinforcing member 24. The leading or front margin 46*c* of the plate 46 is arcuate, and has a radius of curvature such that the front end of the plate 46 will be supported on the point 24*c* formed at the end 24*b* of the reinforcing member 24**.

As shown in FIG. 1, a substantial member of loose-leaf binders 50 of varying sizes, colors, etc. can be supported on the article receiving portion 14 of the device 10. The unfilled binders 50 have a generally triangular configuration which is easily and effectively accommodated by the trapezoidal shape of the portion 14 and the outward curvature of the leading margin **46*c* of the plate 46. Also, as shown in FIG. 1, a sign or placard 52 having any desired promotional, advertising, or the like, indicia imprinted thereon can be supported on the hooks 40**.

In a modified form of the device, provision is made for extending, laterally, the article receiving portion 14 to enable it to accommodate a larger number and variety of binders. To this end, as shown in FIGS. 4 and 5, tubular ends **18*a*—18*a* are provided for the front member 18. Similarly, tubular ends 28*a*—28*a* are provided for the back member 28. The ends (not shown) of back member 20 would also be in tubular form so that all three members, that is, front member 18, back member 20, and back member 28, can be moved laterally in unison. Plates, different in size and configuration than the plate 46**, can be provided to support more, or fewer, binders.

The display units can be grouped side-by-side, if desired, to form a semi-circle or full circle for the display of additional binders or the like for compact conservation of display space on a table or other supporting stand or surface. The display device of the present invention is portable, and is carried and moved with ease from one location to another as may be desired for any particular reason or purpose.

The order blanks 60, which are a significant element of the display device of this invention, are provided with spaced holes **60*a* through the upper margin thereof for receiving the hooks 44 on the portion 16**. In a preferred form of the invention, each of the order blanks comprises three sheets, namely, the original or first sheet, a dealer's copy or second sheet, and a customer's copy or third sheet. Carbon paper advantageously is provided between the sheets so the dealer's copy and the customer's copy will conform exactly to the original or first sheet after the latter is filled-in by the purchaser.

As stated hereinabove, and as shown in greater detail in FIG. 6, the order blanks 60 have indicia imprinted thereon which can be correlated with various features of the sample loose-leaf binders 50 positioned on the article receiving portion 14 of the device 10. The numbered areas of the blank 60 illustrated, represent, sequentially, the steps to be followed by a purchaser in ordering the binders. In step 1, the purchaser fills-in his name, address and phone number. Step 2 involves selecting the sheet capacity of the binder in relation to the ring size. Thus, the area or box 2 shows, for example, that for a ring size of 1 inch, the sheet capacity will be 200. After selecting the ring size, the purchaser designates binder specifications and the quantities of binders desired in areas 3 and 4 of the order blank. Boxes are provided in area 4 to correlate the price of each binder in accordance with the number of binders ordered. Thus, by way of illustration, a binder having a 1¼ inch ring size, when ordered in quantities of 50, will be priced at $3.00 each. A binder having the same ring size, when ordered in quantities of 1,000 will be priced at $2.08 each. Area 5 makes provision for enabling the extension of the figures designated in area 4 to facilitate totalling of the price of the order. Areas 6 and 7 contain a listing of colors for the binders, and the ink to be used for any printing on the binders. Boxes are provided to enable the purchaser to select the colors desired. Area 8 contains space to enable a purchaser to specify extra features available and to specify silk screen cost on the covers of the binders. Area 9 contains various type sizes for selection by the purchaser, while area 10 makes provision for enabling the purchaser to designate the size of type, its location on the front and back covers of the binder, and the copy material he desires to have imprinted on the binder. A second order blank may be needed if the copy material exceeds a certain number of lines, and this is indicated by the purchaser in area 11 of the blank. Areas 12 permit the purchaser to indicate the location and size of type to be used for copy material to be imprinted on the backbone, rib or spine of the binders. Area 14 makes provision for enabling two samples of completed binders to be sent to the purchaser, or the dealer, as desired, for approval. Area 15 provides signature lines for the purchaser and the dealer. The completion of the order blank can be accomplished in a few minutes, and does not, in most instances, require the assistance of a sales person.

It will be understood that the numbered areas and indicia with respect thereto, as described above, are given only by way of illustration. Other numbered areas, with appropriate indicia, can be provided, if desired, for instance, for ordering binders with an extra pocket or pockets on the inside or outside covers or on the backbone, or for a clear plastic overlay on the front cover or back cover and backbone, rib or spine, or for binders with padded covers, or binders with hidden rivets, and the costs of such added binder features, as offered. These and other features, to the extent desired to be included in order blanks in accordance with the principles shown in FIG. 6, make it possible for a dealer to provide a complete ring binder program together with samples showing the type of workmanship with the use of minimal display space and with full implementation of order to meet the needs of unsophisticated as well as sophisticated purchasers without the necessity for consultation with the dealer or store employees and without even moving away from the display device. For the first time, so far as applicants are aware, the present invention overcomes heretofore existent procedures involved in the selection and ordering of ring binders which were complex and cumbersome and involved substantial costs and art work.

Further, in this same connection, as shown in FIG. 1 of the drawing, each of the ring binders 50 has a bordered area 54 marked on the front and back cover, and a bordered area 56 marked on the backbone. Lettering, or letters, or other indicia, of different sizes and orientation, are positioneed on the front and back cover, and the backbone, within the bordered areas 54 and 56 of each binder, to enable a customer to determine for himself the format which will best suit his particular needs. This feature is an important adjunct to the entire system, and further enhances and augments its self-initiating, customeroriented advantages.

While the invention has been illustrated and described in relation to a preferred embodiment thereof, it should be understood that various modifications may be made in said embodiment without deviating from the spirit and scope of the invention.

What is claimed is:

1. A point-of-purchase display device for supporting and displaying loose-leaf binders and for supporting order blanks for enabling a purchaser to selectively order the binders in accordance with specifications which best meet the purchaser's requirements, comprising a self-supporting loose-leaf binder receiving portion, and an order blank supporting portion associated with the loose-leaf binder receiving portion, said binder receiving portion having a base frame which has a front facing member joined at its ends to rearwardly and inwardly extending side members, each of said side members being joined at its rearwardmost end to a back member which is substantially parallel to and shorter in length than the front facing member, said base frame further having a support member joined to the front member and the back member of the base frame between the side members and extending outwardly from the front member of the base frame, said binder receiving portion also having a side support frame provided with upwardly extending members joined to the base frame at the front facing member thereof, each of the upwardly extending members of the side support frame having rearwardly and inwardly extending side members joined to the upper end thereof, the rearwardmost end of each of the side members of the side support frame being joined to a back member which is substantially parallel to the back member of the base frame of the binder receiving portion, said order blank supporting portion of the display device having upwardly extending binder receiving portion engaging members joined to the back members of the base frame and the side support frame of the binder receiving portion, said binder receiving portion engaging members having means for detachably receiving an order blank supporting frame, said order blank supporting frame having upwardly extending substantially vertical members joined to a horizontally extending order blank receiving member for supporting a plurality of order blanks in an elevated position above the loose-leaf binder receiving portion of the display device, said order blanks having indicia thereon which enable a purchaser to self-initiate the ordering to his exact specifications of a binder, or binders, supported on the loose-leaf binder receiving portion of the display device.

2. A display device according to claim 1 wherein said order blank is provided with a plurality of designated areas, each of said areas containing indicia which relate to a different aspect of the overall specifications of the loose-leaf binders supported on the loose-leaf binder receiving portion whereby a purchaser, by making entries in each of said areas, can order binders to meet his specifications as to quantity, price, size, color, capacity, type size, copy material and location thereof, ink color, and the like, without the assistance of sales personnel.

3. A device according to claim 1 wherein the front facing member and back member of the base frame, and the back member of the side support frame, of the loose-leaf binder receiving portion are laterally extendible to enable the loose-leaf binder portion to support fewer, or more, binders, as desired, on the device.

4. A device according to claim 1 wherein binders supported on the loose-leaf binder receiving portion vary in size and have indicia of different size and orientation on the front and back cover, and the backbone thereof, which provides means for enabling a purchaser to select a binder size and format which best meets his needs.

5. A display device according to claim 1 wherein a loose-leaf binder supporting shelf is provided for the base frame of the loose-leaf binder receiving portion, said shelf being adapted to engage the side members and the outwardly extending portion of the support member of the base frame.

* * * * *